US010034547B1

(12) United States Patent
Pan

(10) Patent No.: US 10,034,547 B1
(45) Date of Patent: Jul. 31, 2018

(54) RECLINABLE OFFICE CHAIR

(71) Applicant: Oasyschair Co., Ltd., Tainan (TW)

(72) Inventor: Toung-Chun Pan, Tainan (TW)

(73) Assignee: Oasyschair Co., Ltd., Tainan (TW)

( * ) Notice: Subject to any disclaimer, the term of this patent is extended or adjusted under 35 U.S.C. 154(b) by 0 days.

(21) Appl. No.: 15/448,676

(22) Filed: Mar. 3, 2017

(51) Int. Cl.

| | |
|---|---|
| ***A47C 9/00*** | (2006.01) |
| ***A47C 9/02*** | (2006.01) |
| ***A47C 1/032*** | (2006.01) |
| ***A47C 7/00*** | (2006.01) |

(52) U.S. Cl.
CPC ..... *A47C 1/03255* (2013.01); *A47C 7/004* (2013.01)

(58) Field of Classification Search
CPC ..... A47C 1/03255; A47C 7/004
USPC ..... 297/313, 314, 461; 248/188.7, 188.8, 248/188.9, 163.1
See application file for complete search history.

(56) References Cited

U.S. PATENT DOCUMENTS

| | | | | |
|---|---|---|---|---|
| 4,099,697 A | | 7/1978 | Von Schuckmann | |
| 5,044,587 A | | 9/1991 | Degen | |
| 5,285,992 A | * | 2/1994 | Brown | B66F 7/0608 108/147 |
| 5,524,967 A | | 6/1996 | Glockl | |
| 5,639,056 A | * | 6/1997 | Mecalf | A47B 91/00 248/188.7 X |
| 5,649,740 A | * | 7/1997 | Hodgdon | A47C 1/03255 248/575 |
| 6,003,944 A | * | 12/1999 | Glockl | A47C 3/18 297/313 |
| 6,176,548 B1 | * | 1/2001 | Thole | A47C 3/026 297/302.1 |
| 6,209,958 B1 | * | 4/2001 | Thole | A47C 3/026 297/302.1 |
| 6,601,818 B1 | * | 8/2003 | Larsen | A47C 3/0255 248/158 |
| 6,685,268 B2 | * | 2/2004 | Meyer | A47C 7/448 297/313 |
| 6,688,689 B1 | * | 2/2004 | Thorn | A47C 3/0252 297/314 X |
| 7,100,983 B1 | * | 9/2006 | Gant | A47C 3/025 297/314 X |
| 7,396,080 B2 | * | 7/2008 | Suhr | A47C 3/026 297/313 |
| 7,547,067 B2 | * | 6/2009 | Keilhauer | A47C 3/02 297/313 |
| 8,075,056 B2 | * | 12/2011 | Glockl | A47C 3/026 297/313 X |

(Continued)

*Primary Examiner* — Rodney B White
(74) *Attorney, Agent, or Firm* — Alan D. Kamrath; Kamrath IP Lawfirm, P.A.

(57) ABSTRACT

A reclinable office chair includes a reclination adjustment unit coupled to a bottom base disposed at the bottom of the office chair and having an angle limiting element disposed below and spaced apart from a connecting element abutting against carrying elements. When a user sitting on the office chair tilts the office chair in a predetermined direction, the connecting element and the carrying elements, whose movement is restricted by a rim of the bottom base, are stopped from tilting further as soon as the angle limiting element tilts to an extent to come into contact with the rim, not only allowing the office chair in operation to be tilted within a predetermined safety range in any direction, but also enhancing the anti-slip effect which takes place between the office chair and the floor.

3 Claims, 13 Drawing Sheets

(56) References Cited

U.S. PATENT DOCUMENTS

| | | | | |
|---|---|---|---|---|
| 8,303,041 | B2 * | 11/2012 | Gasser | A47C 7/002 297/461 X |
| 8,888,184 | B2 * | 11/2014 | Meyer | A47C 3/0252 297/258.1 |
| 9,016,786 | B2 * | 4/2015 | Glockl | A47C 3/22 297/313 |
| 9,526,341 | B2 * | 12/2016 | Glockl | A47C 3/026 |
| 9,763,520 | B1 | 9/2017 | Pan | |
| 9,770,107 | B2 * | 9/2017 | Glockl | A47C 9/002 |
| 9,839,296 | B2 * | 12/2017 | Ballendat | A47C 7/44 |
| 9,861,202 | B2 * | 1/2018 | Qi | A47C 3/026 |
| 2002/0043846 | A1 * | 4/2002 | Brauning | A47C 3/026 297/314 |
| 2005/0127264 | A1 * | 6/2005 | Mettler | E04H 12/2246 248/519 |
| 2005/0167553 | A1 * | 8/2005 | Mettler | A47B 23/042 248/188 |
| 2009/0134305 | A1 * | 5/2009 | Tsai | H05K 5/0234 248/687 |
| 2009/0159763 | A1 * | 6/2009 | Kim | F16M 13/00 248/174 |
| 2011/0175414 | A1 * | 7/2011 | Asbjornsen | A47C 9/002 297/313 |
| 2012/0193496 | A1 * | 8/2012 | Li | F16M 11/041 248/316.1 |
| 2013/0276845 | A1 * | 10/2013 | Moulton | A45B 9/04 248/188.9 X |
| 2014/0151526 | A1 * | 6/2014 | Duncan | A47G 33/12 248/523 |
| 2015/0272331 | A1 | 10/2015 | Glockl | |
| 2016/0088944 | A1 * | 3/2016 | Walser | A47C 3/02 297/313 |

* cited by examiner

RECLINABLE OFFICE CHAIR

BACKGROUND OF THE INVENTION

Field of the Invention

The present invention relates to reclinable office chairs and, more particularly, to a reclinable office chair provided in form of a tall office chair and tiltable in a forward-backward direction and/or a left-right direction. An angle limiting element is coupled to a predetermined point of a reclination adjustment unit disposed at the bottom of the reclinable office chair to not only allow a sitter to tilt the reclinable office chair safely within a predetermined safety range in any direction, but also enhance the anti-slip effect which takes place between the office chair and the floor.

Description of the Prior Art

To take a rest while at work, persons whose work require them to stand for a long period of time, such as sale assistants and hairdressers, usually sit on a tall office chair 40 (shown in FIG. 11) while standing on their feet. The office chair 40 comprises a support portion 10, a bottom base 20 coupled to the lower end of the support portion 10, and a seat portion 30 disposed on the upper end of the support portion 10, as well as has its height adjustable. Although a person can relax the legs by sitting on the office chair 40 while at work, the person sometimes has to lean forward in order to work and thus inevitably tilts the office chair 40. However, only a portion of the rim of the bottom base 20 of the office chair 40 thus tilted rests on the floor. As a result, the office chair 40 thus tilted is so unstable that the sitter has to exert a force for balancing the office chair 40 at the expense of the user's relaxation.

To solve the drawbacks of the aforesaid office chair, U.S. Pat. No. 9,763,520, entitled Reclinable Office Chair, discloses a reclination adjustment unit disposed at the bottom of the office chair. The reclination adjustment unit balances itself on the floor properly, resiliently and steadily. Due to the reclination adjustment unit, the office chair tilted in a forward-backward direction and/or a left-right direction demonstrates directional stability relative to the floor in a manner not to lose the directional stability even when a sitter tilts the office chair in any direction, thereby allowing the office chair to provide a comfortable seat for the sitter to sit on, regardless of whether the office chair is upright or tilted in any direction.

The aforesaid office chair has its bottom coupled to the reclination adjustment unit whereby the office chair is precisely, steadily underpinned by the floor whenever the office chair is tilted in a forward-backward direction and/or a left-right direction. However, the office chair does not restrict its angle of inclination. As a result, the office chair in operation is predisposed to an overly large angle of inclination.

The present invention is intended to improve the aforesaid invention of U.S. Pat. No. 9,763,520, entitled Reclinable Office Chair, so that the office chair designed to be tiltable in a forward-backward direction and/or a left-right direction includes an angle limiting element coupled to a predetermined point of a reclination adjustment unit disposed at the bottom of the reclinable office chair to not only allow a sitter to tilt the reclinable office chair safely in any direction within a predetermined safety range, but also enhance the anti-slip effect which takes place between the office chair and the floor.

SUMMARY OF THE INVENTION

The present invention, which is intended to overcome a drawback of the prior art, that is, a conventional reclinable office chair described above and provided in form of a tall office chair which cannot be tilted in any direction within a predetermined safety range when operating, provides a reclinable office chair including a reclination adjustment unit coupled to a bottom base disposed at a bottom of the office chair having an angle limiting element disposed below and spaced apart from a connecting element abutting against carrying elements. When a user sitting on the office chair tilts the office chair in a predetermined direction, the connecting element and the carrying elements, whose movement is restricted by a rim of the bottom base, are stopped from tilting further as soon as the angle limiting element tilts to an extent to come into contact with the rim, not only allowing the office chair in operation to be tilted within a predetermined safety range in any direction, but also enhancing the anti-slip effect which takes place between the office chair and the floor.

The first objective of the present invention is to provide a high office chair tiltable in any direction within a predetermined safety range when operating. A reclination adjustment unit is coupled to a bottom base disposed at a bottom of the office chair and comprises the bottom base, a connecting element, high-toughness carrying elements, and a concealing element. A limiting segment extends outward from each of two ends of each said carrying element and is confined to between the bottom base and the connecting element to effectuate directional penetration. The limiting segments which protrude from the connecting element and the opposing limiting segments which protrude from the bottom base are positioned in place by a fastening element, so that the connecting element and the bottom base are separated by an appropriately flexible distance. The concealing element has a centrally-located through hole penetrable by a lower segment of an upright support portion of the office chair, so that the lower segment of the upright support portion of the office chair fits tightly in a sleeve segment disposed at a corresponding segment of the connecting element. To be tiltable safely in any direction, the reclination adjustment unit includes an angle limiting element is disposed below and spaced apart from the connecting element penetrated by the limiting segments extending outward from ends of the carrying elements, respectively. Apertures disposed at the angle limiting element are penetrated by the limiting segments extending outward from other ends of the carrying elements, respectively, allowing the angle limiting element to be underpinned by a corresponding rim of the bottom base. When a user sitting on the office chair tilts the office chair in a predetermined direction, the connecting element and the carrying elements, whose movement is restricted by the rim, are stopped from tilting further as soon as the angle limiting element tilts to an extent to come into contact with the rim, thereby allowing the office chair in operation to be tilted within a predetermined safety range in any direction.

The second objective of the present invention is to provide an office chair including a reclination adjustment unit coupled to a bottom base disposed at the bottom of the office chair. Stepped spaces are concavely disposed at predetermined points on the downward surface of the bottom base. A protruding rod segment at one end of each anti-slip pad is fitted in and thus held within the inner portion of the space. An outer end of each anti-slip pad, that is, an abutting end, is contained in the outer portion of the space, thereby enhancing the anti-slip effect which takes place between the office chair and the floor.

The third objective of the present invention is that the reclination adjustment unit coupled to the bottom base disposed at the bottom of the office chair and is that the sleeve segment is not only disposed centrally at and pressed tightly against the connecting element, but is also extended, both upward and downward, from the connecting element. In consequence, the lower segment of the upright support portion of the office chair can be fitted tightly in the sleeve segment and thus subjected to appropriate directional restriction.

BRIEF DESCRIPTION OF THE DRAWINGS

FIG. 7-1 is an enlarged view of the reclination adjustment unit at the bottom of FIG. 7;

FIG. 8-1 is an enlarged view of the reclination adjustment unit at the bottom of FIG. 8, showing that the reclination adjustment unit is tilted and pressed downward;

DETAILED DESCRIPTION OF THE EMBODIMENT OF THE INVENTION

Figure 1:
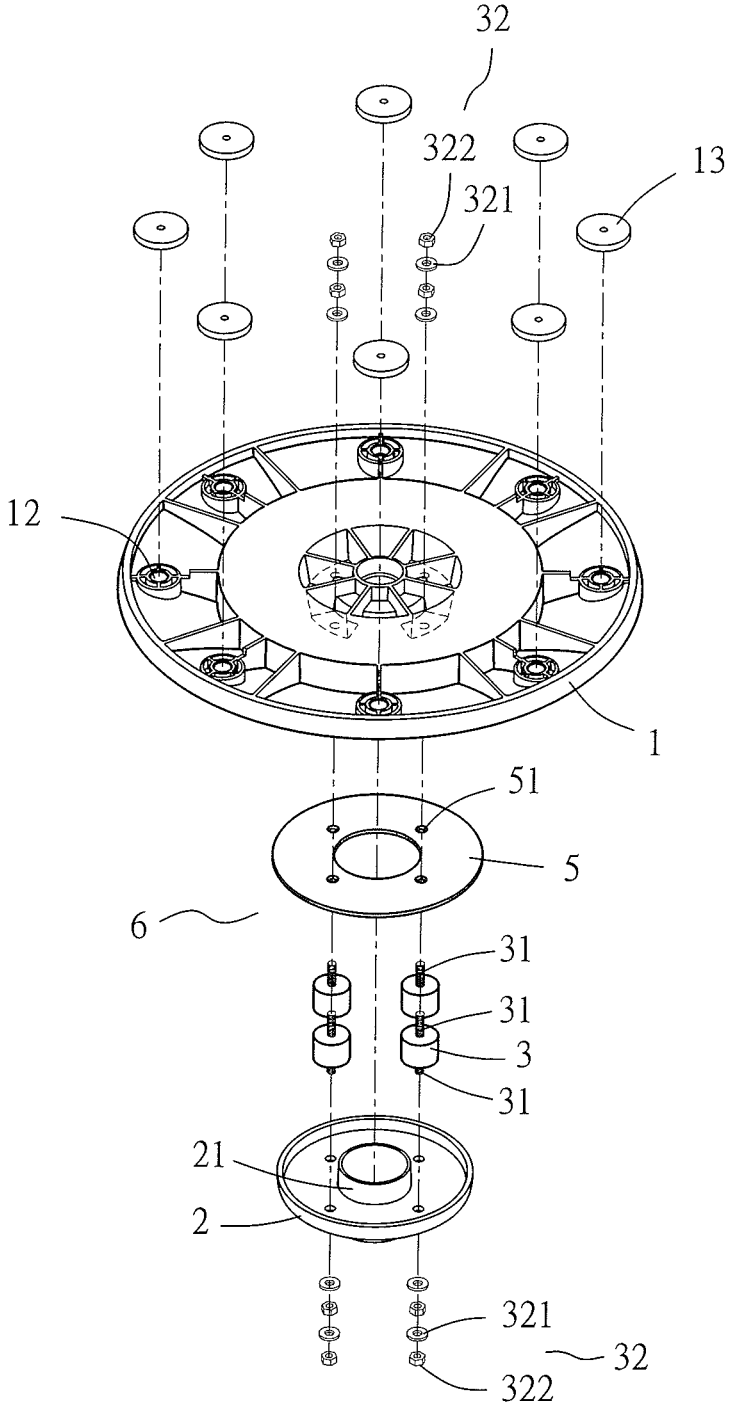
FIG. 1 is a bottom exploded view of a bottom base and related components of an office chair according to the present invention.
Figure 2:
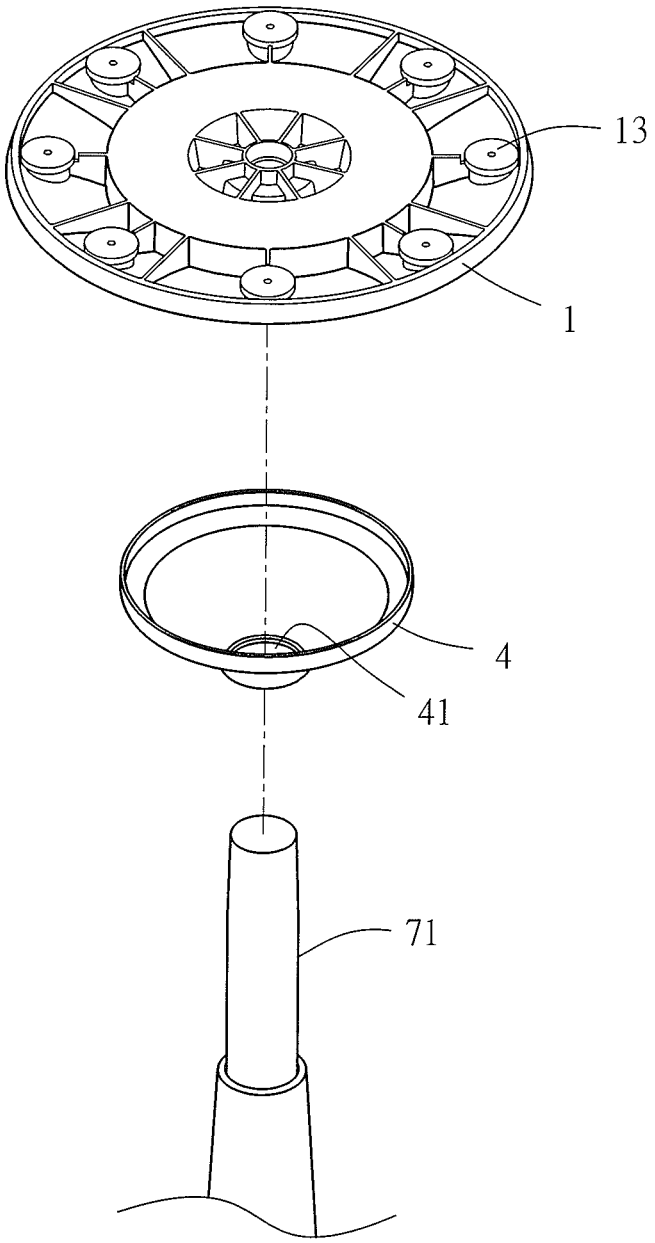
FIG. 2 is a bottom exploded view of the assembled bottom base and related components of the office chair according to the present invention.
Figure 3:
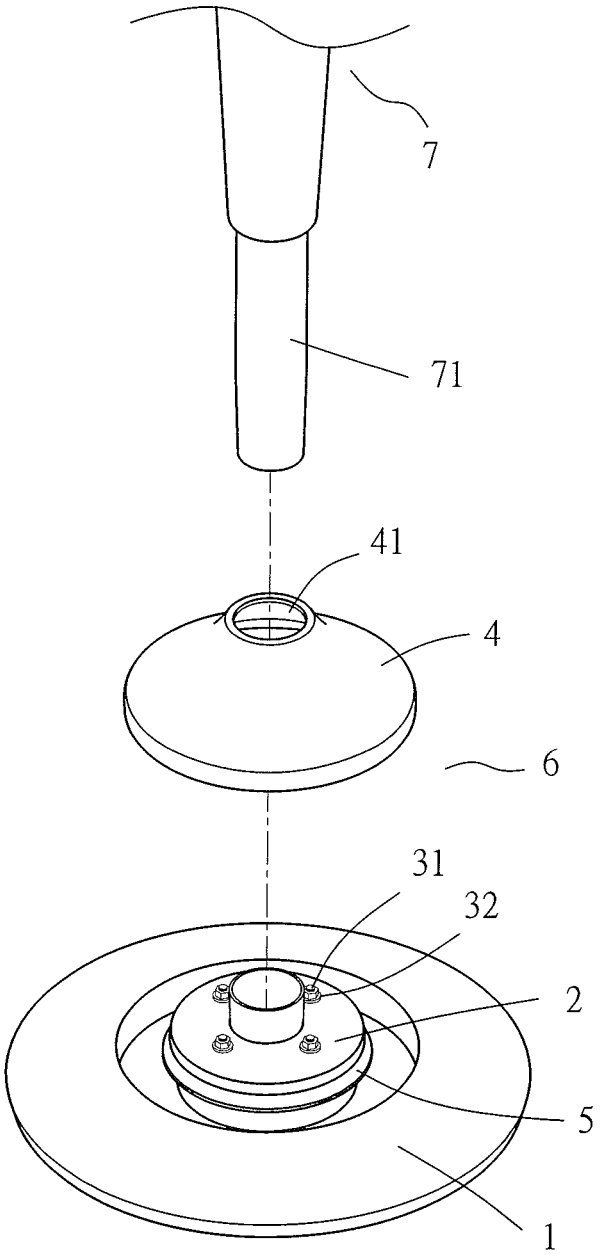
FIG. 3 is a front exploded view of the assembled bottom base and related components of the office chair according to the present invention.

Referring to FIG. 1 and FIG. 2, a reclinable office chair provided by the present invention and in the form of a tall office chair 7 allows a sitter to tilt the reclinable office chair safely within a predetermined safety range in any direction. A reclination adjustment unit 6 is coupled to a bottom base 1 disposed at the bottom of the office chair 7 and comprises the bottom base 1, a connecting element 2, high-toughness carrying elements 3, and a concealing element 4. A limiting segment 31 extends outward from each of the two ends of each carrying element 3 and is confined to between the bottom base 1 and the connecting element 2 to effectuate directional penetration. The limiting segments 31 which protrude from the connecting element 2 and the opposing limiting segments 31 which protrude from the bottom base 1 are positioned in place by a fastening element 32 (the fastening element includes a check washer 321 and a screw nut 322), so that the connecting element 2 and the bottom base 1 are separated by an appropriately flexible distance. The concealing element 4 has a centrally-located through hole 41 penetrable by the lower segment of an upright support portion 71 of the office chair 7. The lower segment of the upright support portion 71 of the office chair 7 fits tightly in a sleeve segment 21 disposed at a corresponding segment of the connecting element 2. The reclination adjustment unit 6 was claimed by U.S. Pat. No. 9,763,520 but is not regarded as a technical feature to be claimed by the present invention.

Figure 10:
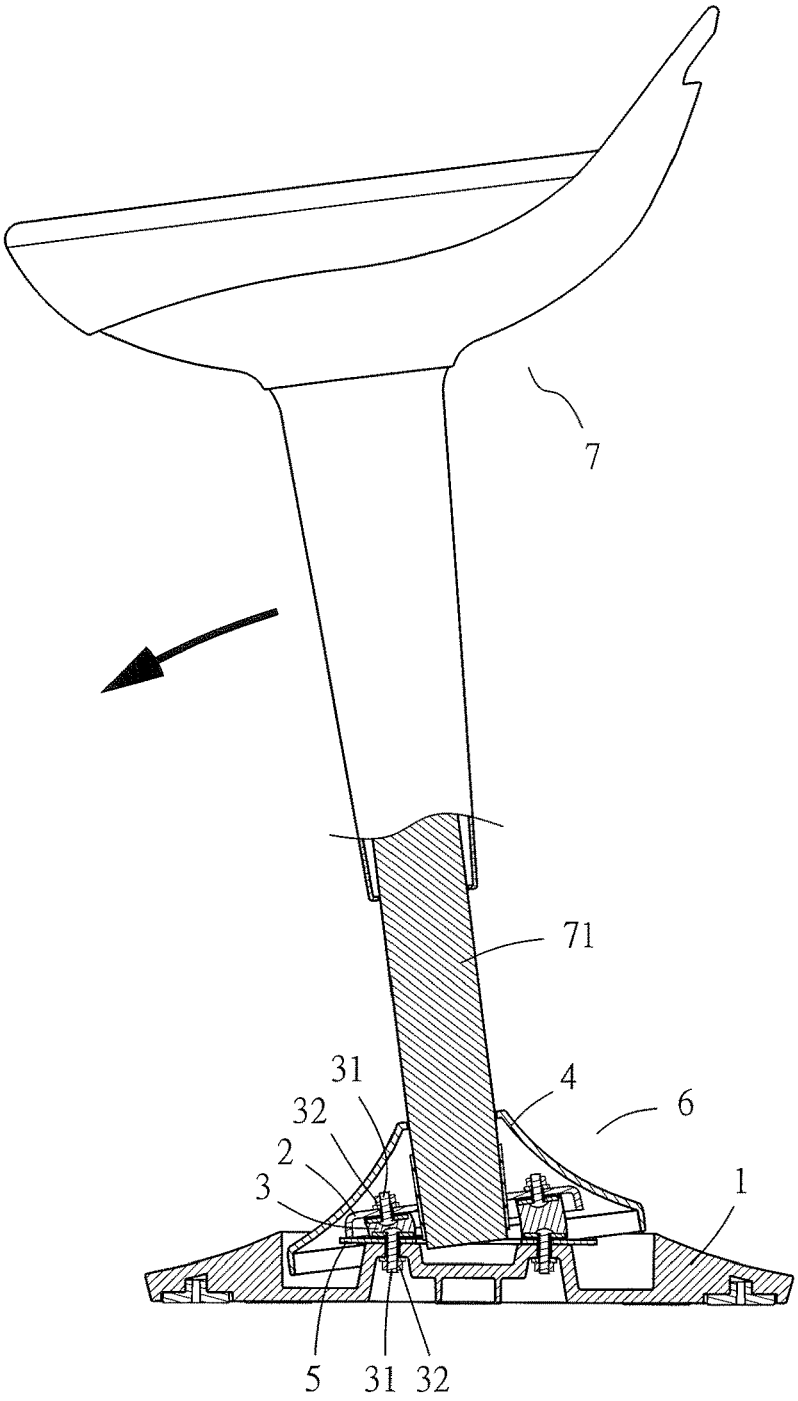
FIG. 10 is a cross-sectional view of the reclination adjustment unit shown in FIG. 9 and coupled to the bottom of the office chair according to the present invention, showing that the reclination adjustment unit is tilted forward and backward.
Figure 11:
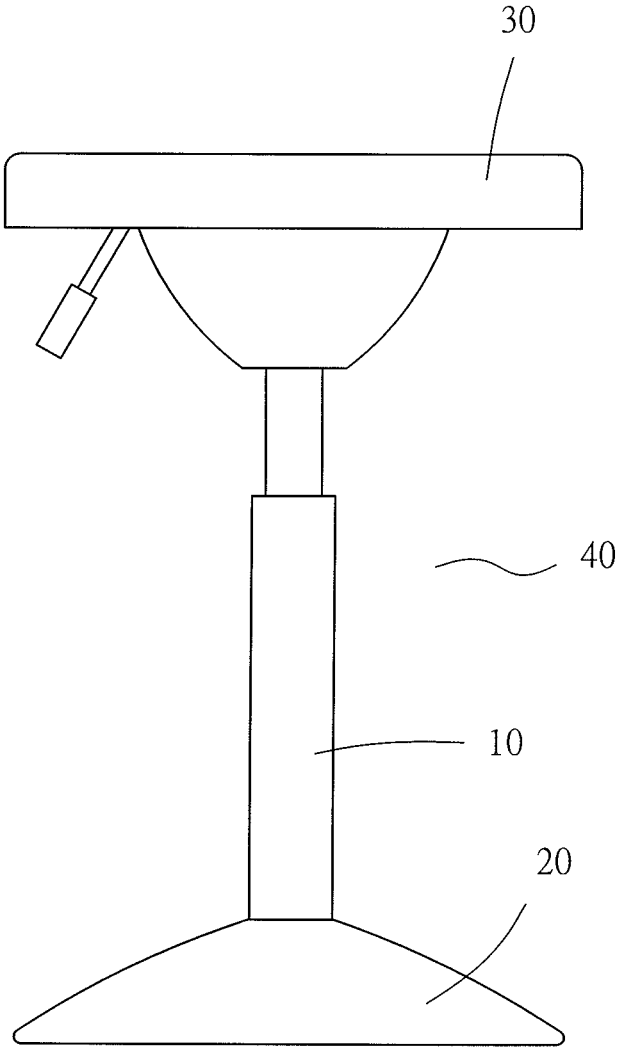
FIG. 11 (Prior Art)
FIG. 11 (PRIOR ART) is a front schematic view of a conventional office chair.

To be tillable safely in any direction, the reclination adjustment unit 6 includes an angle limiting element 5 (shown in FIG. 1, FIG. 3, FIG. 6, FIG. 7, FIG. 7-1, and FIG. 9) disposed below and spaced apart from the connecting element 2 penetrated by the limiting segments 31 extending outward from ends of the carrying elements 3, respectively. Apertures 51 disposed at the angle limiting element 5 are penetrated by the limiting segments 31 extending outward from the other ends of the carrying elements 3, respectively. The angle limiting element 5 is underpinned by a corresponding rim 11 of the bottom base 1. When a user sitting on the office chair 7 tilts the office chair 7 in a predetermined direction, the connecting element 2 and the carrying elements 3, whose movement is restricted by the rim, are stopped from tilting further as soon as the angle limiting element 5 tilts to an extent to come into contact with the rim (as shown in FIG. 8, FIG. 8-1, and FIG. 10). Therefore, the office chair 7 in operation can be tilted within a predetermined safety range in any direction (for example, the left-right direction shown in FIG. 8 or the forward-backward direction shown in FIG. 10.)

Figure 4:
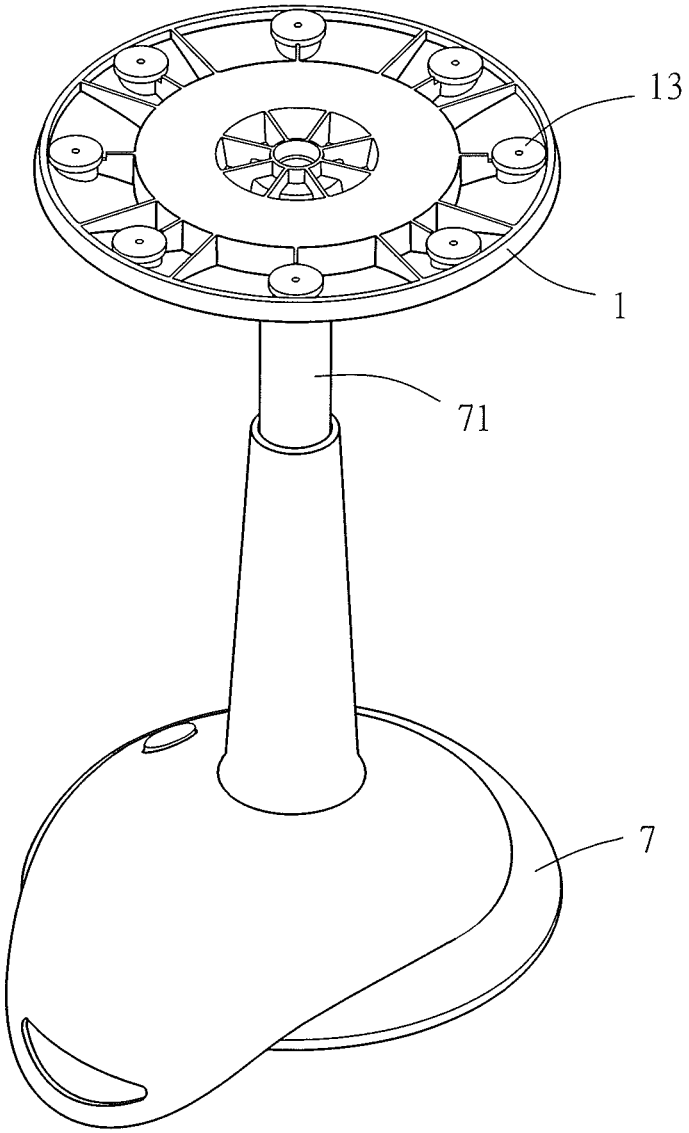
FIG. 4 is a bottom perspective view of a reclination adjustment unit coupled to the bottom of the office chair according to the present invention.
Figure 5:
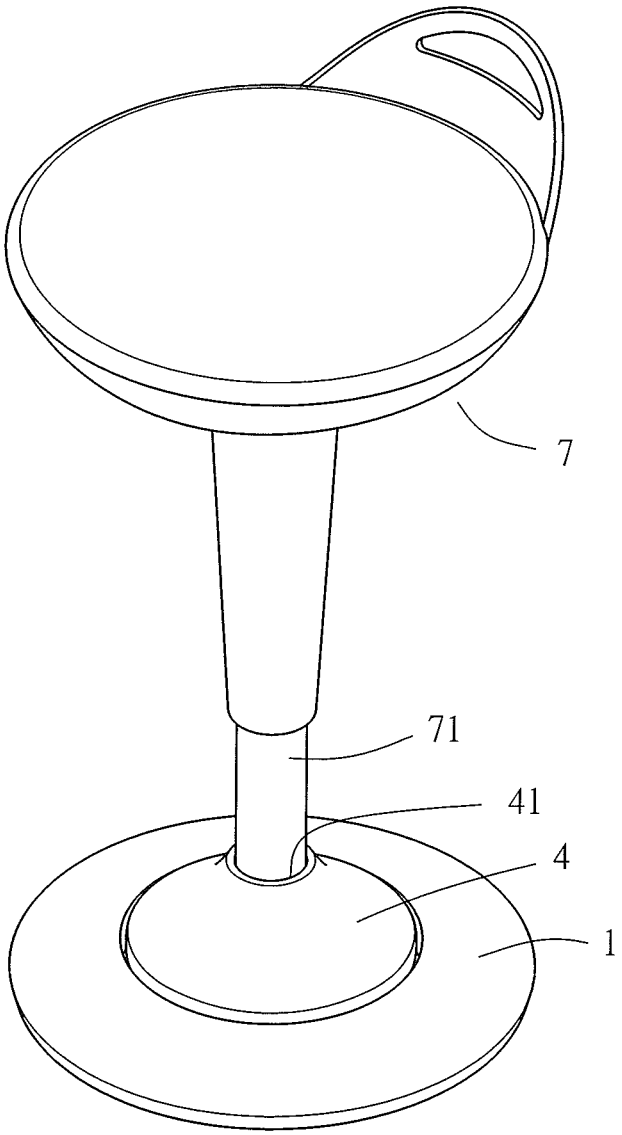
FIG. 5 is a front perspective view of the reclination adjustment unit coupled to the bottom of the office chair according to the present invention.
Figure 6:
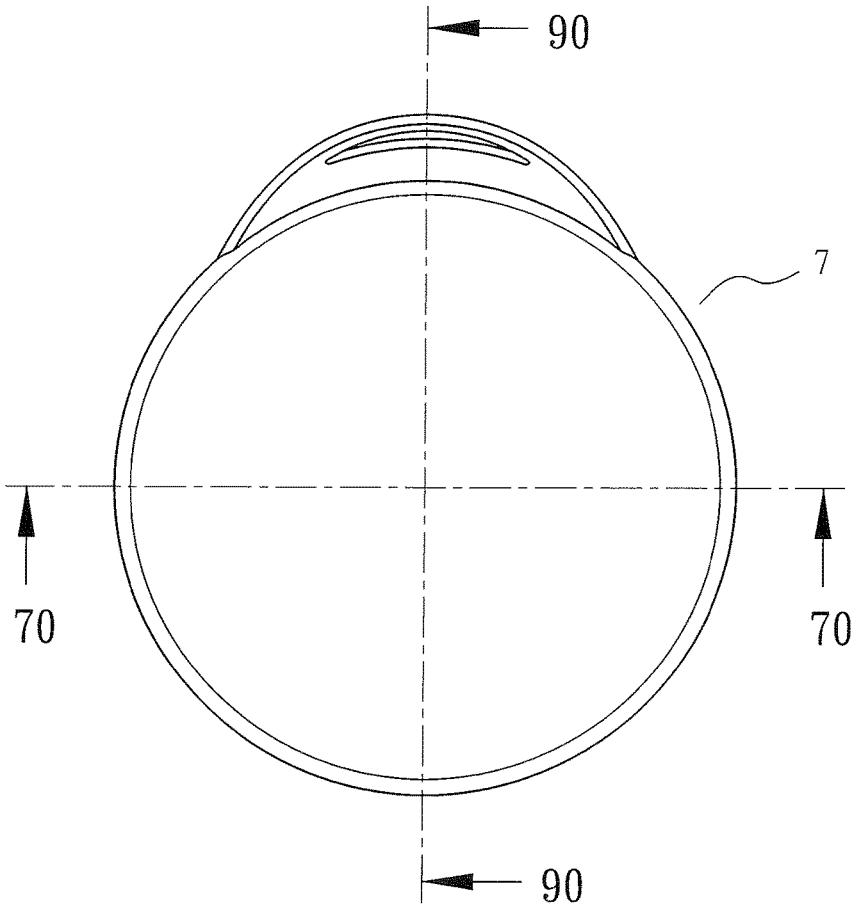
FIG. 6 is a top view of the reclination adjustment unit coupled to the bottom of the office chair according to the present invention.

The reclination adjustment unit 6 coupled to the bottom base 1 disposed at the bottom of the office chair 7 includes stepped spaces 12 (shown in FIG. 1, FIG. 7-1) concavely disposed at predetermined points on the downward surface of the bottom base 1. A protruding rod segment 131 at one end of each anti-slip pad 13 is fitted in and thus held within the inner portion of a corresponding one of the spaces 12. The outer end of each anti-slip pad 13, that is, an abutting end 132, is contained in the outer portion of a corresponding one of the spaces 12, thereby enhancing the anti-slip effect which takes place between the office chair 7 and the floor (as shown in FIG. 4 and FIG. 5.)

Figure 7:
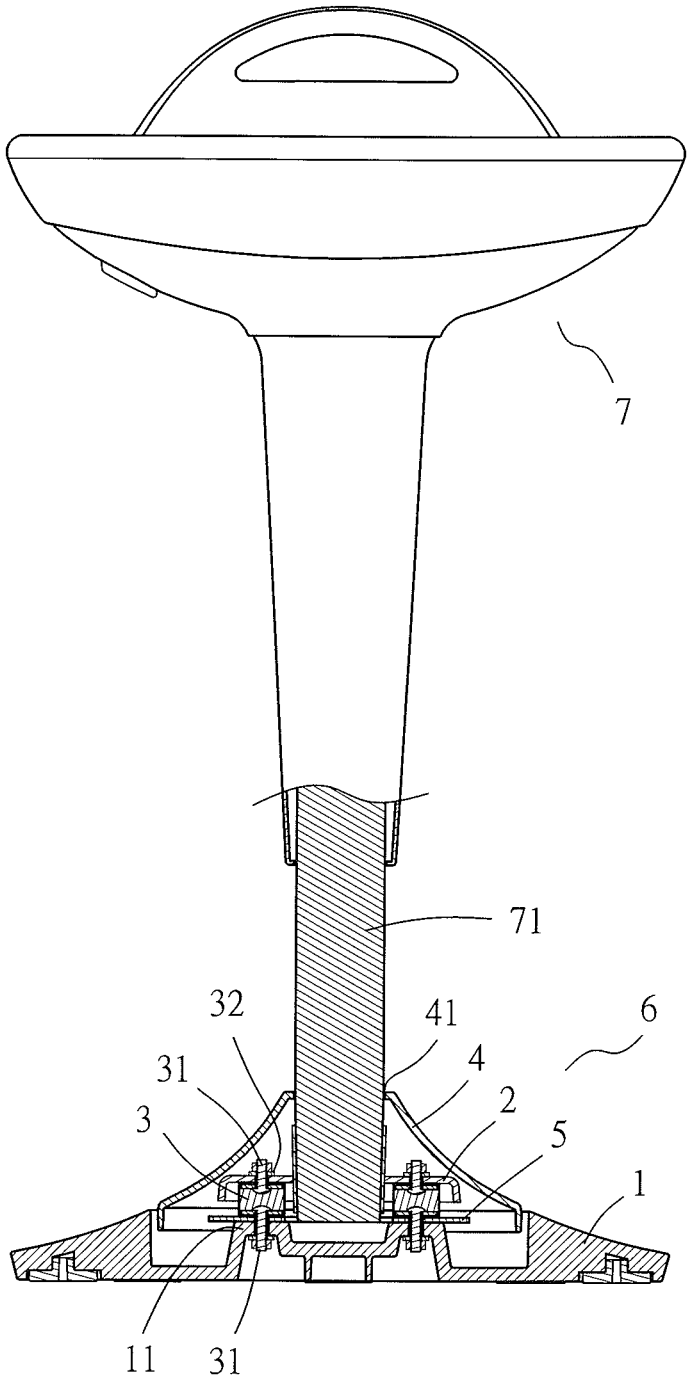
FIG. 7 is a cross-sectional view taken along line 70-70 of FIG. 6.
Figures 1, 7:
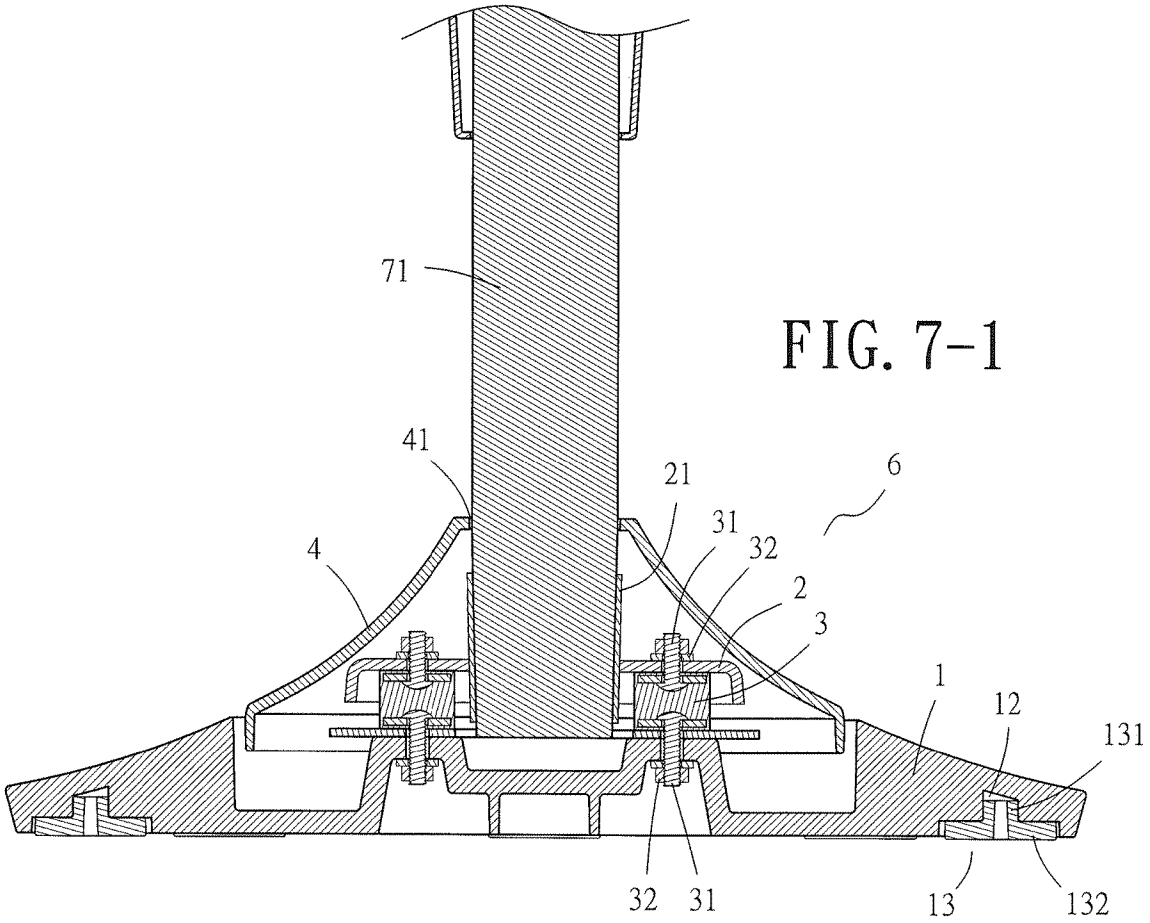
Figure 8:
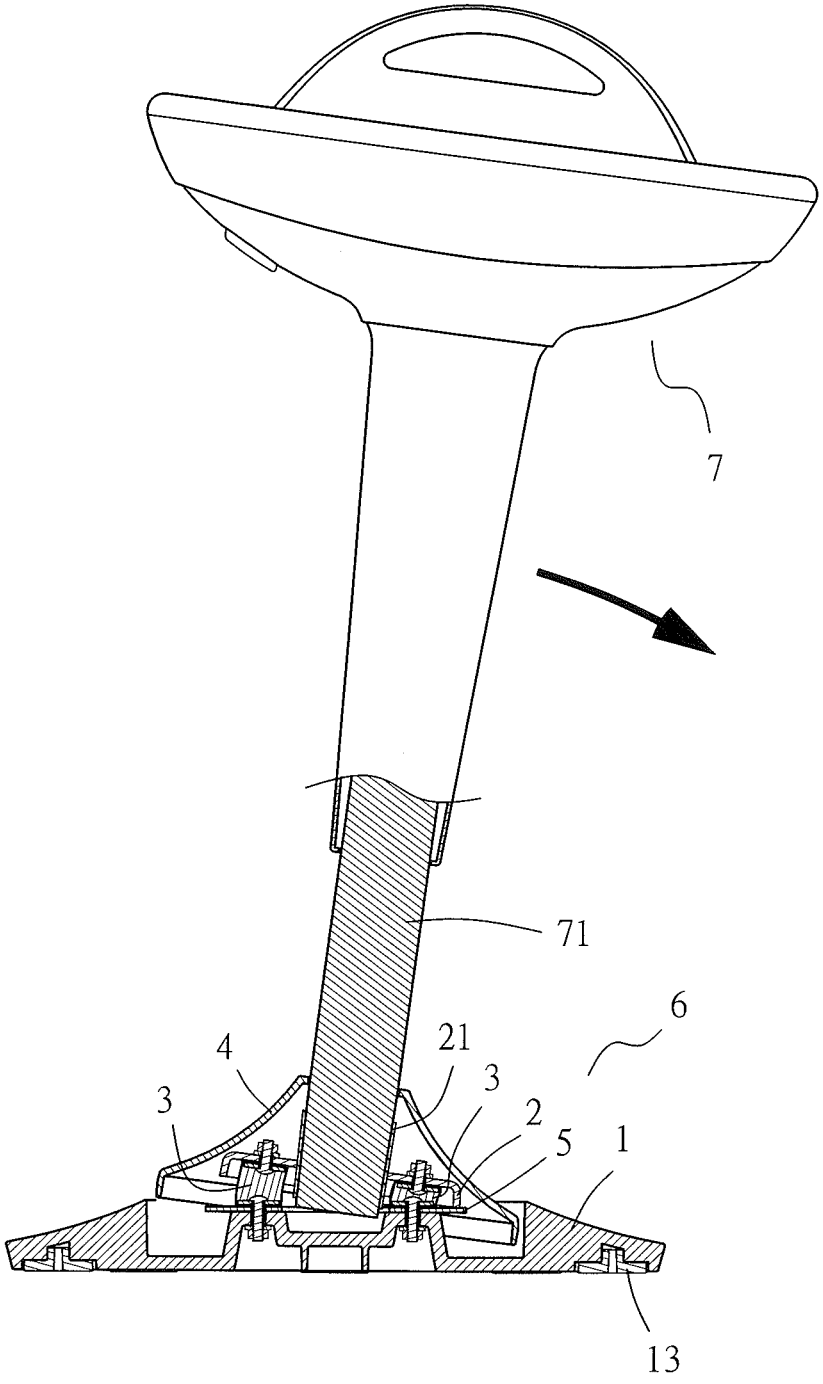
FIG. 8 is a cross-sectional view of the reclination adjustment unit shown in FIG. 7 and coupled to the bottom of the office chair according to the present invention, showing that the reclination adjustment unit is tilted leftward and rightward.
Figures 1, 8:
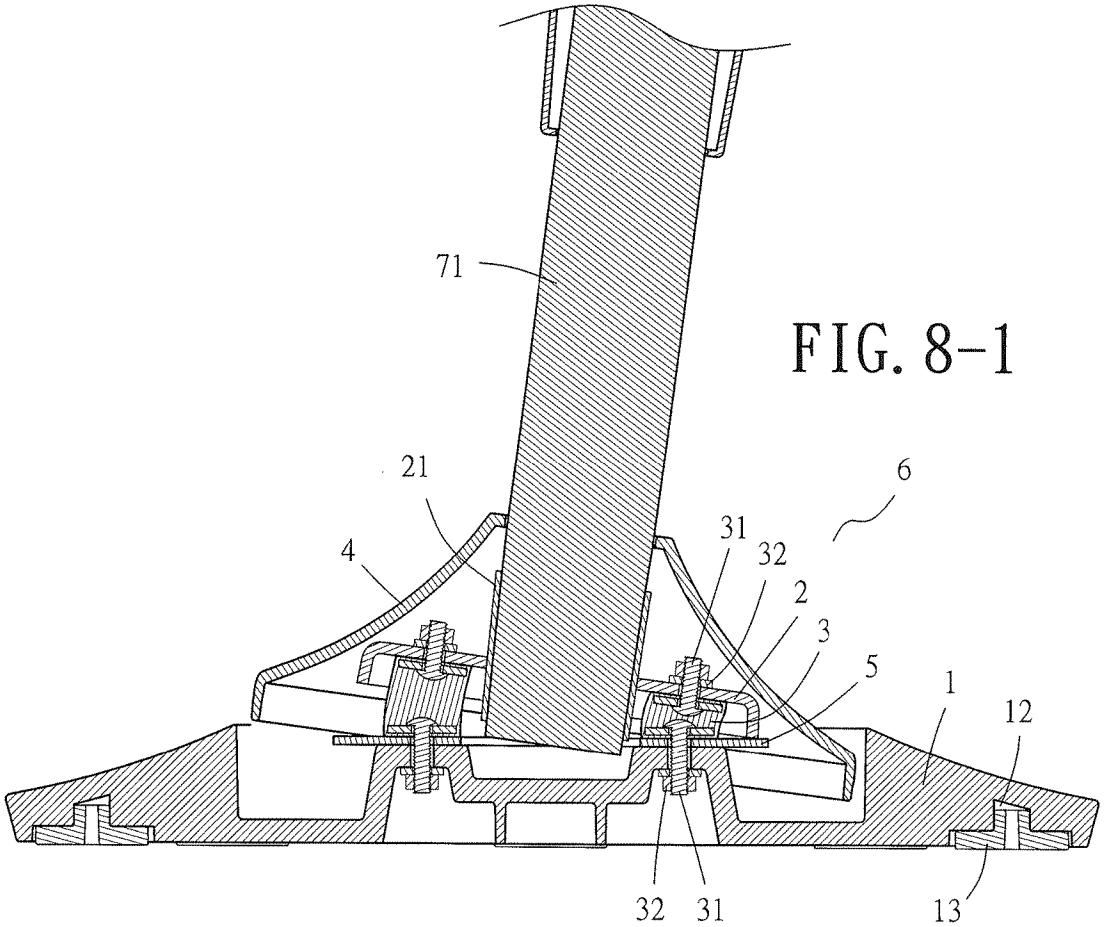
Figure 9:
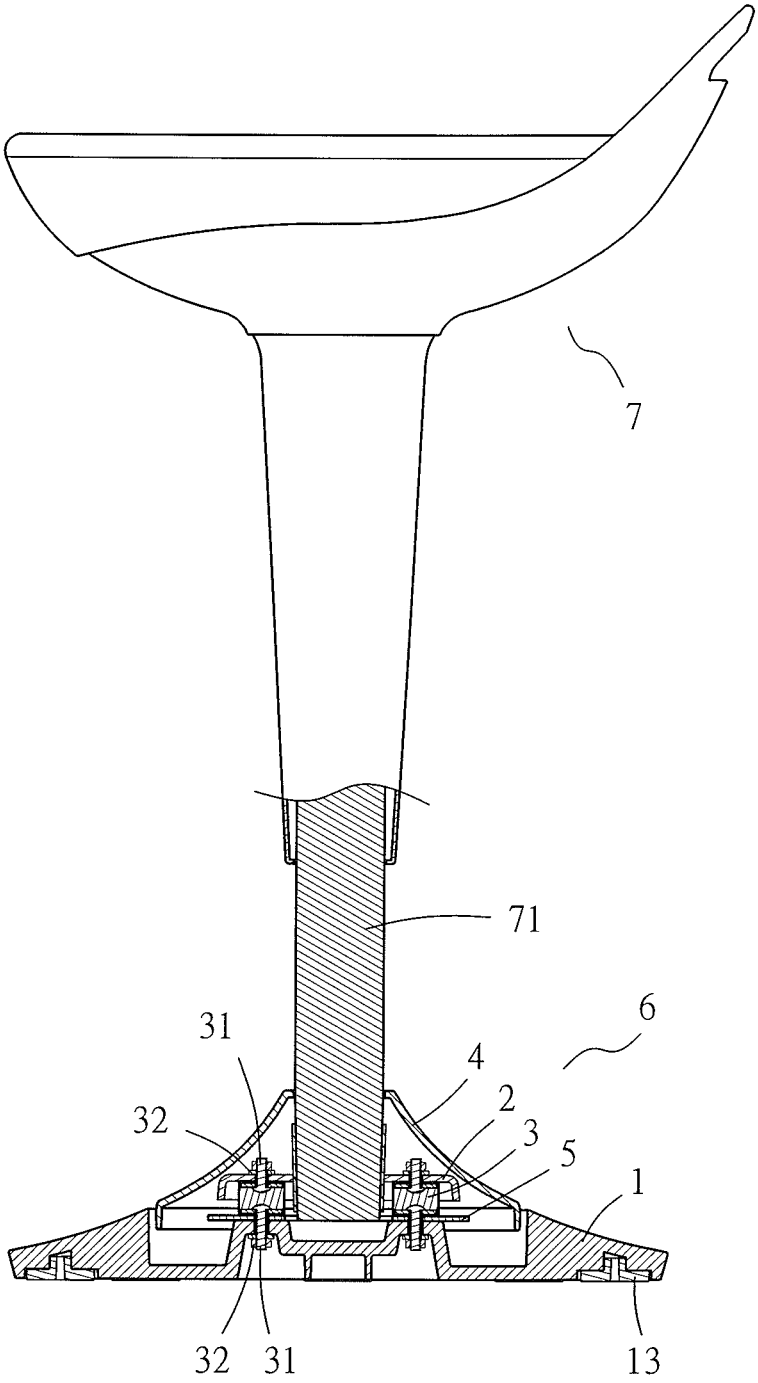
FIG. 9 is a cross-sectional view taken along line 90-90 of FIG. 6.

The reclination adjustment unit 6 coupled to the bottom base 1 disposed at the bottom of the office chair 7 has the sleeve segment 21 not only disposed centrally at and pressed tightly against the connecting element 2 (as shown in FIG. 1 and FIG. 7-1), but also extended, both upward and downward, from the connecting element 2. In consequence, the lower segment of the upright support portion 71 of the office chair 7 can be fitted tightly in the sleeve segment 21 and thus subjected to an appropriate directional restriction.

What is claimed is:

1. A reclinable office chair, provided in form of a high office chair tiltable in any direction within a predetermined safety range when operating, comprising: a reclination adjustment unit coupled to a bottom base disposed at a bottom of the office chair and comprising the bottom base, a connecting element, carrying elements, and a concealing element, wherein a limiting segment extends outward from each of two ends of each said carrying element and is confined between the bottom base and the connecting element to effectuate directional penetration, wherein the limiting segments which protrude from the connecting element and opposing limiting segments of the carrying elements which protrude from the bottom base are positioned in place by a fastening element, wherein the connecting element and the bottom base are separated by a flexible distance, wherein the concealing element has a centrally-located through hole penetrable by a lower segment of an upright support portion of the office chair, wherein the lower segment of the upright support portion of the office chair fits tightly in a sleeve segment disposed at a corresponding segment of the connecting element, wherein to be tiltable safely in any direction, an annular angle limiting element is disposed below and spaced apart from the connecting element penetrated by the limiting segments of the carrying elements extending outward from first ends of the two ends of the carrying elements, respectively, and apertures disposed at the angle limiting element are penetrated by the limiting segments of the carrying elements extending outward from second ends of the two ends of the carrying elements, respectively, with the annular angle limiting element underpinned to the bottom base surrounding the sleeve segment, wherein the connecting element is dish shaped and terminates in a rim abuttable with the angle limiting element when tilted, wherein when a user sitting on the office chair tilts the office chair in a predetermined direction, the connecting element and the carrying elements, whose movement is restricted by the rim, are stopped from tilting further as soon as the annular angle limiting element tilts to an extent to come into contact with the rim, thereby allowing the office chair in operation to be tilted within a predetermined safety range in any direction.

2. The reclinable office chair of claim 1, wherein stepped spaces are concavely disposed at predetermined points on a downward surface of the bottom base, wherein a protruding rod segment at an end of each anti-slip pad is fitted in and held within an inner portion of a corresponding one of the stepped spaces, and wherein an outer abutting end of each said anti-slip pad is contained in an outer portion of a corresponding one of the stepped spaces, enhancing an anti-slip effect taking place between the office chair and a floor.

3. The reclinable office chair of claim 1, wherein the sleeve segment is not only disposed centrally at and pressed tightly against the connecting element, but is also extended, both upward and downward, from the connecting element, and wherein the lower segment of the upright support portion of the office chair is fitted tightly in the sleeve segment and subjected to a directional restriction.

* * * * *